United States Patent [19]

Niertit

[11] 4,096,839

[45] Jun. 27, 1978

[54] INTERNAL COMBUSTION ENGINE AIR-FUEL RATIO CONTROL SYSTEM UTILIZING OXYGEN SENSOR

[75] Inventor: Frank Niertit, Webster, N.Y.

[73] Assignee: Stromberg-Carlson Corporation, Rochester, N.Y.

[21] Appl. No.: 660,905

[22] Filed: Feb. 24, 1976

[51] Int. Cl.[2] ..... F02M 7/16

[52] U.S. Cl. ..... 123/139 AW; 123/140 MC; 261/46; 261/50 R; 261/69 R

[58] Field of Search ..... 123/119 EC, 139 AW, 123/119 R, 32 EA, 32 ED, 119 E, 140 MC; 261/69 R, 46, 50 R

[56] References Cited

U.S. PATENT DOCUMENTS

| | | | |
|---|---|---|---|
| 2,600,650 | 6/1952 | Hieger | 261/69 R |
| 3,548,792 | 12/1970 | Palmer et al. | 123/119 X |
| 3,655,170 | 4/1972 | Lazar | 261/69X |
| 3,690,305 | 9/1972 | Shimada et al. | 123/119 EC |
| 3,800,766 | 4/1974 | Schubelk | 261/69 R |
| 3,825,239 | 7/1974 | Rice | 123/119 EC |
| 3,844,304 | 10/1974 | Boothe | 261/69 R |
| 3,861,366 | 1/1975 | Masaki et al. | 123/119 EC |
| 3,866,583 | 2/1975 | Pundt et al. | 123/119 EC |
| 3,903,214 | 9/1975 | Sigwald | 261/69 R |

*Primary Examiner*—Irwin C. Cohen
*Attorney, Agent, or Firm*—William F. Porter, Jr.; Michael F. Oglo

[57] ABSTRACT

An air-fuel ratio control system for an internal combustion engine utilizes an oxygen sensor to maintain a 14.5/1 air-fuel ratio at a first location in an intake manifold to an engine combustion chamber. A method and apparatus is disclosed for adding fuel and/or air to the air-fuel mixture at a second location, between the first location and the engine combustion chamber, so that the engine operates at a high economy, low emission point when idling, running at a substantially constant speed or decelerating and operates at a low economy point, yet still with low emissions, only when accelerating.

8 Claims, 4 Drawing Figures

INTERNAL COMBUSTION ENGINE AIR-FUEL RATIO CONTROL SYSTEM UTILIZING OXYGEN SENSOR

CROSS REFERENCE TO A RELATED APPLICATION

The present application and a co-pending application, Ser. No. 660,906, filed Feb. 24, 1976, now U.S. Pat. No. 4,052,970 entitled, "Air-Fuel Ratio Control System Utilizing Oxygen Sensor and Pressure Differential Sensor" are related, in that they have common specifications and drawings. However, their respective scopes of claim coverages are distinct. The applications have been concurrently filed, and are assigned to a common assignee.

BACKGROUND OF THE INVENTION

1. Field of the Invention

This invention relates generally to internal combustion engines and more particularly to a novel and improved method and apparatus for controlling the air-to-fuel ratio of an internal combustion engine.

2. Description of the Prior Art

The advent of large internal combustion engines for use in automobiles, together with increased concern regarding the environment, has produced engine design objectives which are increasingly complicated and often are contradictory - to build powerful, yet relatively inexpensive and reliable engines and associated controls, while at the same time improving economy of operation and lowering the emissions exhausted by the engines.

In the prior art a number of attempts have been made to achieve such objectives, and such attempts have generally been either too expensive or complicated or, if relatively inexpensive, have been undesirably unreliable. Generally, in prior art systems, attempts have been made to analyze the engine exhaust fumes to determine either the oxygen or emission content and, based on the analysis, to feedback signals to relatively complex control circuitry to adjust the air-fuel ratio being supplied to the engine. These approaches have not been optimal because of the expense and complexity of analyzers which must compensate for the effects of such factors as temperature, pressure and humidity changes in order to analyze the components in the exhaust. In addition, the response times of the necessary feedback systems often have been too slow to both maximize economy and minimize emissions to the extent desired. In those cases in which response times have been decreased, the decrease has been achieved by adding sophisticated and relatively expensive feedback circuitry.

One such prior art approach utilizes an oxygen sensor with a very fast response time to detect the oxygen content of the engine exhaust gas. When the sensor detects departures from the stoichiometric composition, the output voltage of the sensor changes. The sensor output voltage is transmitted to an electronic controller which has output signals to a fuel injection device and to a recirculation valve to adjust the air-fuel ratio to the desired value. Although this system reduces emissions, it is relatively expensive and has a slower response time than is desirable.

SUMMARY OF THE INVENTION

Accordingly, it is an object of the present invention to provide an air-fuel ratio control system which is reliable and relatively simple and inexpensive and has a fast response time.

Another object of the present invention is to provide such a system which substantially reduces the amount of undesirable emissions present in the engine exhaust, while substantially improving the economy of operation of the engine.

Yet another object of the invention is to provide such a system which is adaptable for use with most internal combustion engines.

In one embodiment of the invention, a method and apparatus are disclosed according to which an intake manifold to an engine combustion chamber is provided with two spaced-apart air intakes with throttles. Two spaced-apart fuel pumps are driven by the same shaft. A first fuel pump mixes fuel with air flowing through a first air intake, which is the more remote from the engine combustion chamber, and the oxygen content of the resulting air-fuel mixture is sampled by an oxygen sensor which adjusts the speed of the fuel pump to maintain a 14.5/1 air-gas ratio in the sampled mixture. The second fuel pump, which has a normally closed nozzle and is of the recirculation type, is located between the second air intake and the engine combustion chamber. The nozzle of the second fuel pump is opened by a control mechanism when the engine is accelerating and the vacuum in the intake manifold drops significantly. When the engine is idling or running at a constant speed, the nozzle of the second pump is closed, and the air flowing through the second air intake produces a mixture, having an air-gas ratio which is greater than 14.5/1, flowing into the engine combustion chamber for lean burning. When the engine is accelerating, the nozzle of the second fuel pump is opened, producing a mixture having an air-fuel ratio which is less than 14.5/1 for high torque.

In another embodiment, a method and apparatus are disclosed according to which an intake manifold to a combustion chamber is provided with an air inlet with a first throttle. A second separate air intake is provided with a second throttle and is connected to a burning chamber including an oxygen sensor. A fuel pump is provided and has a first nozzle connected to the second intake and a second open nozzle and third normally closed nozzle connected to the intake manifold. A pressure differential sensor is connected between the second intake and the intake manifold at points between the first nozzle and second, third nozzles, respectively, and the burning chamber and the engine combustion chamber, respectively. The pressure differential sensor maintains equal pressure in the second intake and the air intake manifold by regulating the air flow into the second air intake, and the oxygen sensor maintains the air-fuel ratio of the mixture in the second air intake at 14.5/1. The amount of fuel flowing into the intake manifold is regulated so that high torque or lean burn operating points, respectively, are reached depending upon whether the engine is accelerating or not accelerating, respectively.

BRIEF DESCRIPTION OF THE DRAWINGS

These and other objects and advantages of the present invention will become apparent from the following description of preferred embodiments, taken together with the attached drawings, in which.

DESCRIPTION OF THE PREFERRED EMBODIMENT

Figure 1:
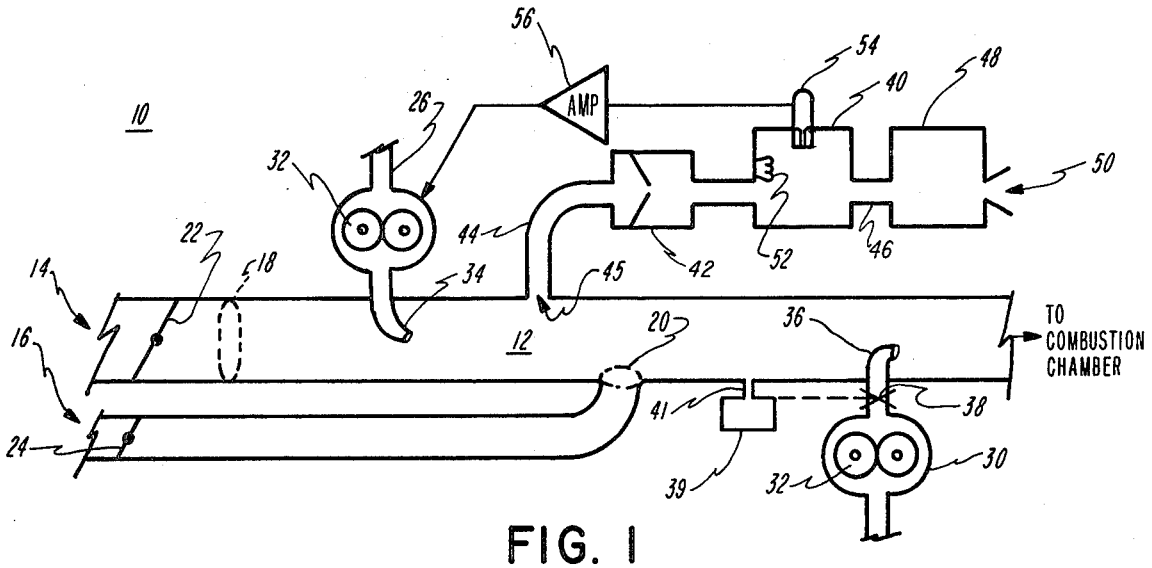
FIG. 1 is a view, in side elevation and partially in diagrammatic form, of one embodiment of an air-fuel ratio control system constructed in accordance with the invention.

Referring now to FIG. 1 there is shown one embodiment of an air-fuel ratio control system, generally designated 10, constructed in accordance with the invention. An intake manifold 12 communicating with a combustion chamber (not shown) of an internal combustion engine is provided with a pair of air intakes 14 and 16, respectively, each having an air inlet, designated 18 and 20, respectively, and a throttle 22 and 24, respectively. Throttles 22 and 24 are connected to the accelerator pedal of an automobile by conventional mechanical linkages, and are both arranged to be moved between a first nearly closed position when the accelerator pedal is released and a plurality of second, increasingly opened, positions as the accelerator pedal is increasingly depressed. The ratio of the cross-sectional area of the air inlet 18 to the cross-sectional area of the air inlet 20 is a predetermined value and may be varied to suit particular applications.

A pair of fuel pumps 26 and 30, driven by a common drive shaft 32, is provided and each of the fuel pumps has a fuel nozzle 34 and 36, respectively, shown with orifices of identical size (although the relative sizes may be varied, if desired). The fuel pump 30 is a recirculating pump. A fuel valve 38, arranged to be actuated by a pressure activated solenoid 39, is provided in the nozzle 36 of the fuel pump 30. The solenoid 39 communicates with the intake manifold 12 via a conduit 41, is arranged to detect the vacuum present in the manifold, and, when the vacuum drops below a predetermined value, to become energized and to open the fuel valve 38. When the vacuum increases above the predetermined value, the pressure activated solenoid 39 becomes de-energized and closes the fuel valve 38. Although the pressure activated solenoid 39 is disclosed herein, a number of other mechanisms - for example, a barometric pressure meter or electronic vacuum detecting control circuitry, may be utilized to effect opening and closing of the fuel valve 38 in response to changes in the vacuum. The fuel nozzle 34 enters the manifold 12 between air inlets 18 and 20, and the fuel nozzle 36 enters the manifold 12 between the air inlet 20 and the combustion chamber of the engine.

The system 10 is further provided with a burning chamber 40 which communicates via a flashback control chamber 42 (which may, for example, contain a bleeder valve or consist of a bubbler containing a non-combustible liquid) and a conduit 44, having an orifice 45, to the intake manifold 12 between the nozzle 34 and the air inlet 20 and via a conduit 46 to a vacuum pump 48 which has an exhaust exit 50 which may communicate directly to the atmosphere or may be connected to the exhaust system of an automobile. The flashback control chamber 42 is arranged to prevent ignition in the burning chamber 40 from spreading into the conduit 45 and the intake manifold 12.

The burning chamber 40 is provided with a constant ignition mechanism — for example, a hot coil 52 connected to a suitable power supply (not shown) — arranged to cause constant ignition of an air-fuel mixture drawn by the vacuum pump 48, from the manifold 12 via the orifice 45, conduit 44 and flashback control chamber 42 into the burning chamber 40. The burning chamber 40 is also provided with an oxygen sensor 54, such as that manufactured by Robert Bosch Corporation, which is arranged to detect the air-fuel ratio of the mixture ignited in the burning or combustion chamber 40 and is set to have an output voltage which is transmitted via an inverter amplifier 56, the output voltage of which is applied to the motor driving the fuel pumps and adjusts the speed of the fuel pump motor so that the air-fuel ratio of the mixture drawn through the orifice 45 is constantly adjusted to a ratio of 14.5/1. The oxygen sensor 54 determines the air-fuel ratio of the ignited mixture by weight from the stoichimetric composition of the exhaust in the combustion chamber 40 with a high degree of accuracy and has a response time which is approximately 10 milliseconds.

Figure 4:
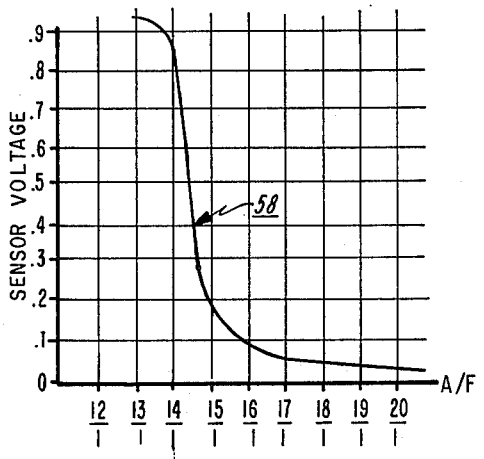
FIG. 4 is a graph plotting the output voltage of an oxygen sensor utilized in the air-fuel ratio control system versus the air-to-fuel ratio in the ignited air-fuel mixture.

A typical graph of output voltage of the sensor 54 versus air-fuel ratio is shown in FIG. 4 in which the operating point to which the sensor 54 is set is designated by the reference numeral 58. When the air-fuel ratio is less than 14.5/1, oxygen is present in the combustion chamber 40, the output voltage of the sensor 54 increases and the speed of the fuel pumps 26 and 30 is reduced. When the air-fuel ratio of the mixture is equal to or less than 14.5/1, no oxygen is present in the exhaust in the combustion chamber 40 and the speed of the fuel pumps 26 and 30 is increased. Because of the fast response time of the oxygen sensor 54, the air-fuel ratio at the orifice 45 is maintained extremely close to the 14.5/1 ratio indicated by the point 58 in FIG. 4.

Figure 3:
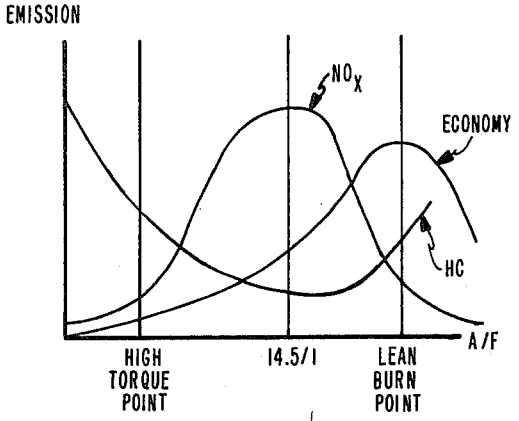
FIG. 3 is a graph plotting nitrogen oxide and hydrocarbon emissions and relative economy of engine operation versus the air-to-fuel ratio in the air-fuel mixture ignited in the engine combustion chamber.

In operation, when the engine is idling or running at a fixed speed, the accelerator pedal is maintained in a fixed position and the throttles 22 and 24 are maintained in their respective first open positions or one of their respective increasingly opened positions and the fuel valve 38 is closed. The oxygen sensor 54 continually adjusts the flow of fuel via the nozzle 34 so that the air-fuel ratio of the mixture drawn into the orifice 45 is 14.5/1. As can be seen from FIG. 3 that ratio is highly unsatisfactory from the standpoints of both emissions and economy. Air is drawn through the inlet 20 by the vacuum present in the intake manifold at a point beyond the mixture sampled by the oxygen sensor 54. Therefore, the air-fuel ratio of the mixture is higher than 14.5/1, and the engine idles or runs at a lean burn point, such as that shown in FIG. 3, which provides substantially greater economy and a lesser amount of emissions.

When the accelerator pedal is depressed, the throttles 22 and 24 are moved to respective increasingly opened positions and the vacuum in the intake manifold instantaneously drops to a very small value. The oxygen sensor 54 maintains the air-fuel ratio at 14.5/1 in the vicinity of the orifice 45. However the pressure activated solenoid detects the drop in vacuum pressure, becomes energized and opens the fuel valve 38. The fuel pumped into the manifold 12 via the nozzle 36 reduces the air-fuel ratio of the mixture entering the combustion chamber to a high torque point, such as that shown in FIG.

3, at which emissions are reduced, while the engine is accelerating. Fuel economy is reduced temporarily as is typically the case with internal combustion engines. As the engine approaches the desired steady state speed, the vacuum in the manifold increases, the solenoid 39 becomes de-energized and the fuel valve 38 is closed. Engine operation then returns to the lean burn point shown in FIG. 3.

Thus, an air-fuel ratio control system such as that shown in FIG. 1 permits an internal combustion engine to be operated at a low emission, high economy lean burn point when idling or running at a steady speed and a low emission, low economy high torque point only while accelerating, resulting in greater overall economy of operation and lower emissions than is available in prior art systems. As will be readily appreciated, by proper adjustment of the cross-sectional areas of the air inlets 18 and 20 and of the fuel nozzles 34 and 36, the high torque and lean burn points may be varied for a particular engine or the operation of a particular engine may be adjusted to conform to predetermined high torque and lean burn points.

Figure 2:
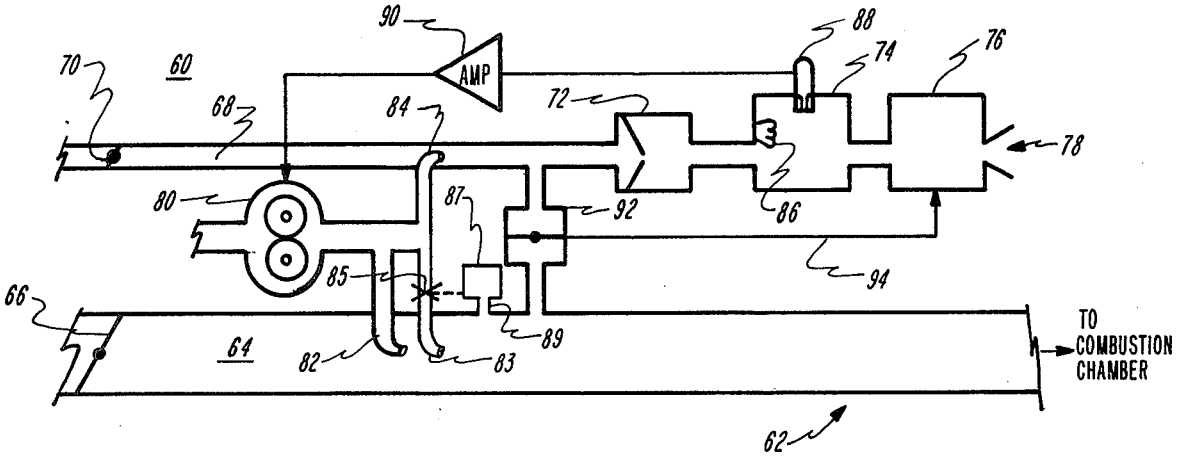
FIG. 2 is a view, in side elevation and partially in diagrammatic form, of a second embodiment of an air-fuel ratio control system constructed in accordance with the invention.

A second embodiment of an air-fuel ratio control system, generally designated 60, is shown in FIG. 2. The system 60 includes an air intake manifold 62 communicating to the combustion chamber of an internal combustion engine and having a first air intake 64 provided with a throttle 66. A second air intake 68, having a throttle 70 is provided and communicates to a flashback control chamber 72, a combustion chamber 74 and a vacuum pump 76 having an exhaust exit 78. The ratio of the cross-sectional area of the intake 64 to that of the intake 68 may be selected to be any known value, K. The throttles 66 and 70 are connected via conventional mechanical linkages to an accelerator pedal and are arranged to be moved between their respective first open positions when the accelerator is released and their respective increasingly opened positions when the accelerator is depressed.

A fuel pump 80 is provided and has fuel nozzles 82, 83 and 84. Nozzles 82 and 83 are arranged to spray fuel into the intake 64, and nozzle 84 is arranged to spray fuel into the intake 68. The ratio of cross-sectional area of the nozzle 82 to that of the nozzle 84 is less than K. The ratio of the total cross-sectional areas of the nozzles 82 and 83 to that of the nozzle 84 is greater than K. A normally closed fuel valve 85 is provided in the nozzle 83 and is arranged to be opened when a pressure activated solenoid 87, connected to the intake 64 by a conduit 89, detects that the vacuum in the intake 64 drops below a predetermined value, as described above in connection with the embodiment shown in FIG. 1. When the vacuum increases above that value, the solenoid becomes de-energized, and the fuel value 85 is closed.

The burning chamber 74 is provided with a hot ignition coil 86 (connected to a power supply - not shown) and an oxygen sensor 88 which is arranged to have an output voltage which is transmitted via an inverter amplifier 90 to the motor of the fuel pump 80 to adjust the air-fuel ratio in the intake 68 to 14.5/1. A pressure differential pressure sensor 92 is connected between the intakes 64 and 68 (at a point between the fuel nozzles 83 and 84, respectively, and the motor combustion chamber and the flashback control chamber 72, respectively) and is arranged to detect differences between the pressures in the intakes 64 and 68, and, when a pressure differential is detected, to transmit an output signal via a line 94 (shown diagrammatically) to change the rate of speed of the vacuum pump 76 in a direction to bring the pressure in the intakes 64 and 68 into equality.

In operation, the oxygen sensor 88 maintains the air-fuel ratio in the intake 68 at 14.5/1. When the motor is idling or running at a constant speed, the throttles 66 and 70 are in their respective first open positions or one of their increasingly opened positions, respectively. The fuel valve 85 remains closed. The pressure differential sensor 92 continuously adjusts the speed of the vacuum pump 76 so that the pressure in the intakes 64 and 68 is equal. Since the cross-sectional areas of the intake 64 is greater than that of the intake 68 (by the factor K) and the ratio of the cross-sectional area of the fuel nozzle 82 to that of the fuel nozzle 84 is less than K, the airfuel ratio in the air intake manifold 64 is greater than the 14.5/1 ratio maintained in the intake 68, and the engine operates at a lean burn point, such as that shown in FIG. 3.

When the accelerator pedal is depressed for acceleration, the throttles 66 and 70 are moved to respective further increasingly opened positions. The pressure differential sensor 92 maintains equal pressures in the intakes 64 and 68 and the oxygen sensor 88 maintains a 14.5/1 air-fuel ratio in the mixture in the intake 68. The vacuum in the intake 64 temporarily drops, and the solenoid 87 opens the fuel valve 85. Since the ratio of the crosssectional areas of the nozzles 82 and 83 to that of the nozzle 84 is greater than K, the air-fuel ratio in the intake 64 is less than the 14.5/1 ratio in the intake 68 and the engine operates at a high torque point, such as that shown in FIG. 3. As the engine approaches a constant speed, the fuel valve 85 is closed, and engine operation returns to the lean burn point shown in FIG. 3. The lean burn and high torque points may be varied, by varying the relative cross-sectional areas of the fuel nozzles 82, 83 and 84 and/or those of the air intakes 64 and 68.

Thus, an air-fuel ratio control system constructed in accordance with the present invention permits an internal combustion engine to operate under all conditions with reduced emissions. In addition, such a system, which is relatively simple and inexpensive compared to prior art systems, permits the engine to be operated extremely economically while idling, operating at a substantially constant speed or decelerating, while losing operational economy only when the engine is accelerating.

In the preferred embodiments the air-fuel ratios for the high torque and lean burn points are 12/1 and 19/1 , respectively. Depending on the particular engines used, those points may very within the ranges of 11/1 - 13/1 and 18/1 - 22/1, respectively.

While the invention has been described with reference to particular embodiments thereof, it will be readily appreciated by those skilled in the art to which the invention pertains that various modifications in form and detail may be made therein without departing from the spirit and scope of the appended claims.

What is claimed is:

1. A method for controlling the air-fuel ratio in an internal combustion engine having a combustion chamber arranged to operate at subatmospheric pressures, an intake manifold communicating with the combustion chamber for providing a flow of air to the combustion chamber, adjustable throttle means in the intake manifold for controlling the flow of air through the intake manifold, and fuel pumping means for introducing a first flow of fuel into the intake manifold and producing an air-fuel mixture, the method comprising the steps of:

continuously sampling the air-fuel ratio of the mixture flowing adjacent a first loation in the intake manifold;

continuously adjusting the air-fuel ratio at the first location to the stoichometric value by adjusting the first flow of fuel into the intake manifold;

substantially continuously providing an additional flow of air at a second location in the intake manifold, spaced apart from the first location in the direction of the combustion chamber, and introducing a second flow of fuel into the intake manifold adjacent the second location in an amount sufficient to reduce the air-fuel ratio of the mixture flowing into the combustion chamber below the stoichometric ratio when engine acceleration is desired.

2. The method of claim 1 wherein the stoichometric value of air-fuel mixture is essentially 14.5/1.

3. A method according to claim 1 wherein the step of continuously sampling comprises the steps of:

continuously burning a portion of air-fuel mixture flowing adjacent the first location in a second combustion chamber which is spaced apart from the engine and the intake manifold, and continuously detecting the amount of oxygen present in the second combustion chamber with an oxygen sensor having a continuous output signal which varies with the amount of oxygen detected.

4. A method according to claim 3 wherein the steps of continuously adjusting includes the steps of:

amplifying and inverting the output signal from the oxygen sensor, and transmitting the amplified and inverted signal to the fuel pumping means for varying the first flow of fuel into the intake manifold to thereby adjust the sampled air-fuel ratio to the stoichometric value.

5. An air-fuel ratio control system for an internal combustion engine having a combustion chamber arranged to operate at subatmospheric pressures, an intake manifold communicating with the combustion chamber for providing a flow of air to the combustion chamber, adjustable throttle means in the intake manifold for controlling the flow of air through the intake manifold, and a first fuel pumping means for introducing a first flow of fuel into the intake manifold and producing an air-fuel mixture, the control system comprising:

first control means, said first control means including means for continuously sampling the air-fuel ratio of the mixture at a first location in the intake manifold and including means for continuously adjusting the first fuel pumping means to adjust the sampled air-fuel ratio to the stoichometric value for the mixture, second air inlet means disposed at a second location in the intake manifold spaced apart from the first location in the direction of the combustion chamber, the second air inlet means being operative to provide a substantially continuous additional flow of air to the intake manifold, thereby normally increasing the air-fuel ratio of the mixture flowing into the combustion chamber above the stoichometric value, and second control means, said second control means including a second fuel pumping means operative when engine acceleration is desired to introduce a second flow of fuel into the intake manifold at a third location spaced apart from the second location in the direction of the combustion chamber in an amount sufficient to reduce the air-fuel ratio of the mixture flowing into the combustion chamber below the stoichometric value.

6. The system claimed in claim 5 wherein the stoichometric value of the air-fuel mixture is essentially 14.5/1.

7. The system claimed in claim 5, wherein:

the means for continuously sampling the air-fuel mixture comprises a burning chamber, the burning chamber being connected to the intake manifold adjacent the first location via a valve means for preventing ignition spreading from the burning chamber into the intake manifold and having continuous ignition means, for continuously receiving portions of the mixture flowing adjacent the first location and continuously burning the portions received, and the means for continuously adjusting said first fuel pumping means comprising an oxygen sensor, located in the burning chamber, for continuously detecting the oxygen present in the combustion chamber and continuously generating an output signal, which varies with the amount of oxygen detected, for adjusting the first fuel pumping means.

8. The system claimed in claim 5 wherein the second fuel pumping means comprises a fuel pump having a fuel nozzle communicating with the intake manifold and having a normally closed fuel valve and a pressure actuated solenoid communicating with the intake manifold, responsive to a relative vacuum below a predetermined value to become energized and open the fuel valve and responsive to a relative vacuum above the predetermined value to become de-energized and close the fuel valve.

* * * * *